United States Patent [19]

Difiglio

[11] 3,994,412

[45] Nov. 30, 1976

[54] TAMPERPROOF BREAKAWAY PORT

[75] Inventor: Joseph John Difiglio, Libertyville, Ill.

[73] Assignee: Abbott Laboratories, North Chicago, Ill.

[22] Filed: Mar. 11, 1976

[21] Appl. No.: 665,736

[52] U.S. Cl. ..... 220/266; 128/214 D; 128/272; 215/249; 222/541

[51] Int. Cl.[2] ..... B65D 41/32

[58] Field of Search ..... 220/265, 266; 215/249, 215/250, 251, 253; 222/541; 128/214 D, 272

[56] References Cited

UNITED STATES PATENTS 3,509,879 5/1970 Bathish et al. ..... 128/214

3,858,739 1/1975 Turner et al. ..... 220/266

*Primary Examiner*—George T. Hall

*Attorney, Agent, or Firm*—Robert L. Niblack; Neil E. Hamilton

[57] ABSTRACT

An easy tear-open or breakaway port for a container wherein the breakaway line is provided by a preweakened portion having a reduced wall section with the width varying in a uniform and progressive manner from a minimum width to a maximum one. The breakaway feature is readily adaptable to plastic containers and can be utilized in conjunction with a handle or gripping member to facilitate the tearing along the preweakened portion.

10 Claims, 7 Drawing Figures

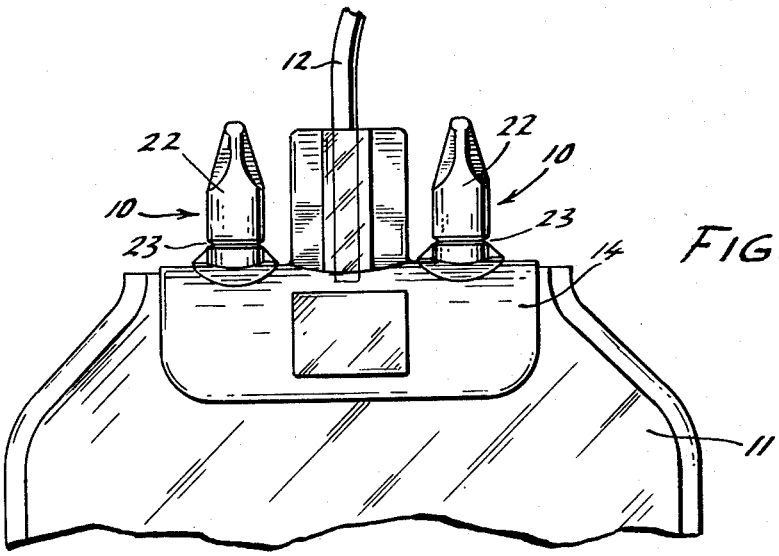
FIG. 1.
FIG. 2.
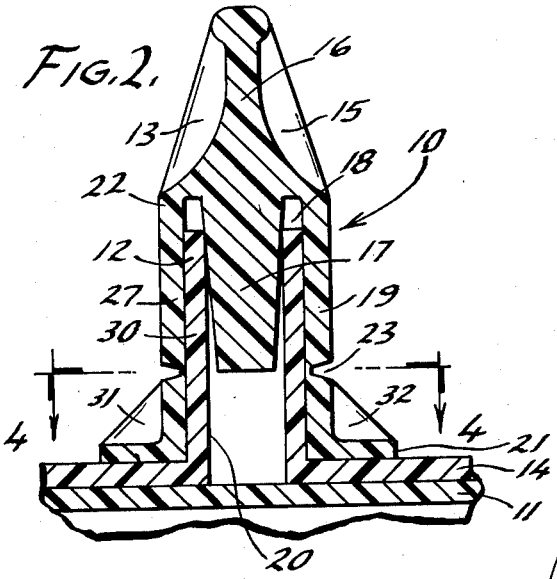
FIG. 3.
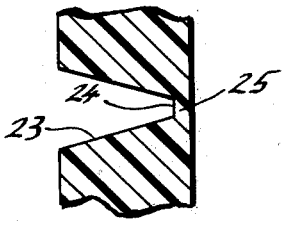
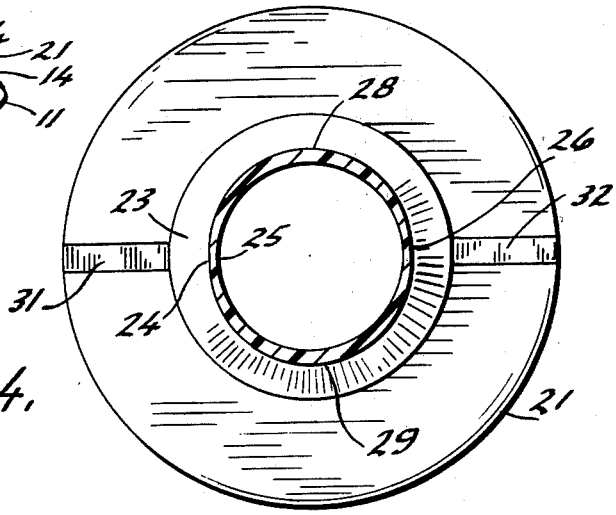
FIG. 4.

FIG. 6.
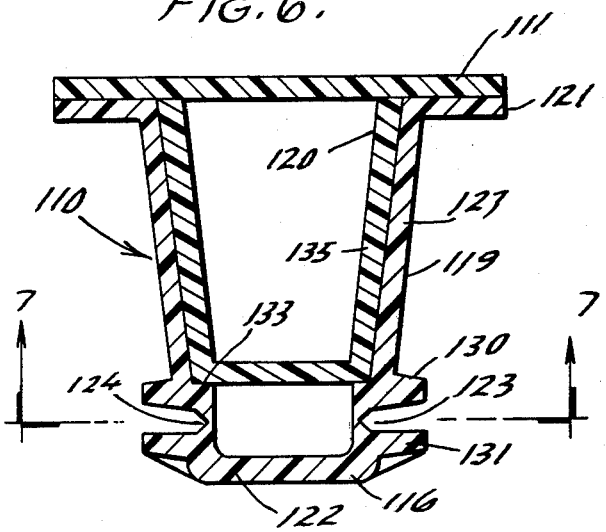
FIG. 5.
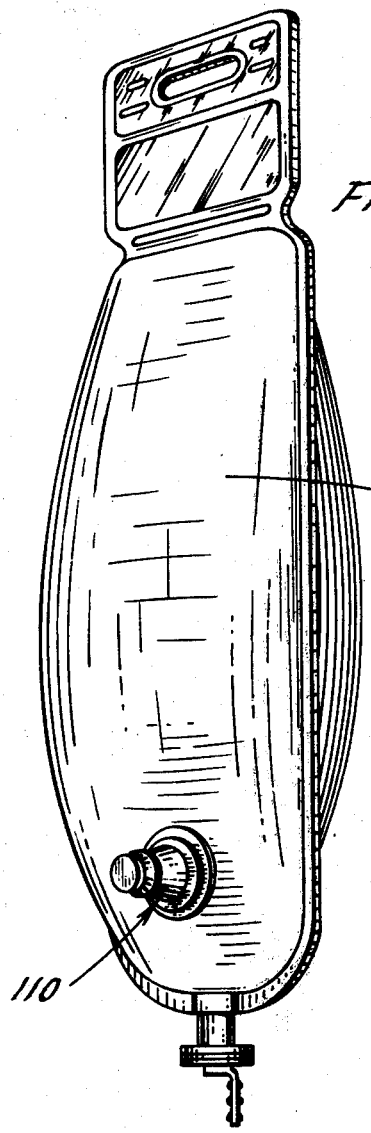
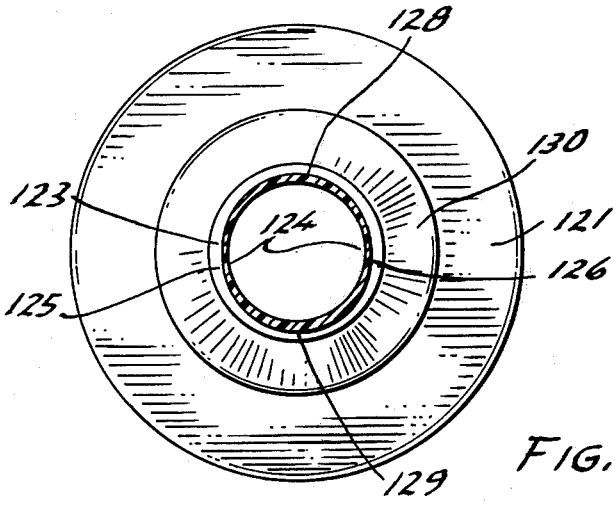
FIG. 7.

TAMPERPROOF BREAKAWAY PORT

BACKGROUND OF THE INVENTION

This invention relates to a tamperproof breakaway port for a container. More particularly, this invention relates to an easy access opening in a container which will afford a sterile access entry point and is particularly suitable for utilization in plastic containers.

Tear-open seals of the type concerned with in this invention are described in U.S. Pats. Nos. 1,327,190; 2,073,941; 2,893,611; 2,894,510 and 3,509,879. In all of these patents with the exception of U.S. Pat. No. 2,894,510 a preweakened wall section forming in effect a groove to preweaken the area along the desired tear is described. In these patents the preweakened line has the same cross section of wall thickness. In U.S. Pat. No. 2,894,510, flap members are provided which are torn apart to expose an entry port. The problem with preweakened sections of uniform cross section, or of the utilization of flaps, to provide a tamperproof entry port is in that they do not afford a uniform tear with consistent results. In the instance where handles are provided in conjunction with the tear open port as in U.S. Pat. No. 3,509,879, additional molding techniques must be utilized in applying the tamperproof feature to a bag. In addition, extra sealing steps must also be utilized in order to place the tamperproof port on a flexible container.

It is an advantage of the present invention to afford a readily opened tamperproof port for access to a container. Other advantages are a tamperproof port which affords a sterile injection site into a blood bag or an I.V. solution container; an injection port which will provide for a positive tear open seal and be readily adaptable to being fabricated on a flexible plastic container.

SUMMARY OF THE INVENTION

The foregoing advantages are accomplished and the shortcomings of the prior art are overcome by the present tamperproof breakaway port wherein a weakened portion is provided in a tubular walled port which is in communication with the container. The weakened portion separates a cover section and that section secured to the container. The weakened portion is formed by a reduced wall section extending in a substantially transverse plane with respect to the longitudinal axis of the tubular port. The reduced wall section extends peripherally into the wall of the tubular port from the exterior surface thereof and varies in width in a uniform and progressive manner from a minimum to a maximum width. One embodiment has the reduced wall section formed with two minimum and maximum widths with the thinnest wall sections disposed diametrically opposite from each other with the widest wall sections in between.

DESCRIPTION OF THE DRAWING

A better understanding of the present tamperproof breakaway port for a container will be accomplished by reference to the drawing wherein:

FIG. 1 is a partial view in side elevation of a blood bag container illustrating two of the tamperproof breakaway ports of this invention.

FIG. 2 is an enlarged view in vertical section of one of the breakaway ports shown in FIG. 1.

FIG. 3 is an enlarged view in vertical section of a portion of the reduced wall thickness illustrating a portion of the breakaway feature.

FIG. 4 is a view in horizontal section taken along line 4—4 of FIG. 2 to illustrate the varying cross sectional dimensions of the breakaway wall feature.

FIG. 5 is a view in side elevation of an alternative embodiment of this invention showing the breakaway port feature on a flexible I.V. bag.

FIG. 6 is an enlarged view in vertical section of the breakaway port used in conjunction with the I.V. bag in FIG. 5.

FIG. 7 is a view in horizontal section taken along line 7—7 of FIG. 6.

DESCRIPTION OF ONE EMBODIMENT

Proceeding to a detailed description of the present invention, the tamperproof breakaway tubular port units 10 are shown in FIG. 1 in conjunction with a resinous plastic, flexible blood bag 11 having the usual central outlet tube 12 with an overflap 14 from which extend outlet tube 12 and the tamperproof units 10. As best seen in FIG. 2, the tamperproof units 10 are positioned on bag 11 with each unit 10 having a port 20 with a central core 17, loosely positioned in tubular port 20. An outer skirt portion 27 extends around port 20 and an annular tapering groove 18 in unit 10 accommodates the straight wall 30 of tubular port 20, with breakaway port 10 thus forming a cover section 22 for port 20. Unit 10 is provided with a tab or cap portion 16 having flanges 13 and 15 to secure it to external wall 19. It will be seen that wall 19 in addition to providing skirt 27 has an annular sealing flange 21 for sealing to flap 14 and ultimately to bag 11. Reinforcing ribs 31 and 32 connect flange 21 with skirt 27. Disposed in wall 19 is a weakened portion 23 extending in a substantially transverse plane with respect to the longitudinal axis of port unit 10 and extending peripherally into the wall 19. As best seen in FIG. 3, weakened portion 23 is of a generally V-shaped configuration with a flat inner reduced base wall section 24. It is preferably formed at a compound angle of 30°.

An important aspect of the weakened portion 23 is the fact that wall portion 24, although forming a continuous single groove, is not of a uniform dimension but as best seen in FIG. 4, has a varying width in a uniformly progressive manner from a minimum width at points 25 and 26 to a maximum width at points 28 and 29. It will be noted that these minimum and maximum widths are located diametrically opposite to each other with the minimum widths located adjacent ribs 31 and 32. In a preferred manner, these wall thicknesses as represented by 25 and 26 will be approximately 0.005 inch to 0.008 inch and at points 28 and 29 will be 0.014 to 0.017 inch.

In FIG. 5 another embodiment is described as breakaway unit 110. Similar numbers are employed to indicate similar parts as in the previous embodiment except that they are in the 100 series. The I.V. bag 111 is of the type described in U.S. Pat. No. 3,915,212 entitled "Flexible Medical Fluid Container Having a Combined Fill and Administration Port and Reinforced Hanger" and is commonly assigned. It will be noted in this particular embodiment that weakened portion 123 is disposed adjacent to extended wall portions 130 and 131 formed from external wall 119 and tab portion 116, respectively, with tab portion 116 and wall portion 131 forming in effect a cover section 122 for port 120. It will also be noted from FIG. 6 that the weakened portion 123 is of a generally V-shaped configuration throughout its entire circumferential or circualar length. As this particular tamperproof port is used in conjunction with an I.V. flexible bag, it will have a reseal unit 135 contained in unit 110 and will be accommodated therein by means of a shoulder portion 133 in wall 119. One difference between embodiments 10 and 110 is that in unit 110, there are no reinforcing ribs adjacent the smallest widths 125 and 126. The same dimensions will apply as in the wall thickness 24 in unit 10: the dimension for wall 124 at its smallest widths at 125 and 126 will be in the range of 0.005 to 0.008 inch and its widest dimension at 128 and 129 will be in the range of 0.014 to 0.017 inch.

Operation

A better understanding of the advantages of the tamperproof units 10 and 110 will be had by a description of their fabrication and operation. Referring to unit 10 first, cap 22 will be molded separately from port 20. At time of fabrication, flap 14 will be placed on bag 11 and flange 21 extending from wall 19 placed on flap 14 which seats skirt 27 over port wall 30. Flange 21 is then sealed to flap 14 which in turn is sealed to bag 11. When it is desired to gain access to tubular port 20, indicia will be indicated on wall 19 as to the weakest points, namely 25 and 26 in preweakened portion 23. Tab 16 will be grasped by the operator and will be bent or flexed in a direction toward and away from points 25 and 26 to cause an initial break at either of these points. Bending of tab 16 in the indicated direction will cause a complete tear around wall 24 with the tear originating at the minimum wall thickneses 25 or 26 and proceeding in both a clockwise and counterclockwise manner through the widest widths 28 and 29 to the opposing minimum thicknesses. Removal of cover section 22 of unit 10 which extends above the preweakened portion 23 will be effected, which will include the central core 17 whereas flanges 21 and that portion of wall 19 extending between flange 21 and preweakened portion 23 will remain secured to bag 11. It should be noted that central core 17 will aid in a tearing along preweakened section 23 and wall 24 in that it will provide an internal flexing on tube 20 so as to induce the shearing effect in wall 19. This is the purpose as to the core 17 terminating immediately adjacent the preweakened portion 23 although to the inside of tubular port 20. Tearing will also be aided by placement of stabilizing ribs 31 and 32 adjacent weakest points 25 and 26. One sharp movement will effect complete removal and access to bag 11 by means of a piercing cannula through remaining tube 20.

The operation and fabrication of port unit 110 is substantially the same as that indicated for tamperproof port unit 10 except that unit 110 with wall 119 having extended portion 130 and tab portion 116 with extension 131 will be sealed integrally to bag 111 by means of flange 121. Cover section 122 will thus be sealed over reseal 135 with the sealing of flange 121 to bag 111. Indicia will be indicated on tab portion 116 to indicate the minimum wall thicknesses 125 and 126. At either point, tab portion 131 would be grasped and pulled to initially effect a tearing action. The tearing would then proceed in a simultaneous clockwise and counterclockwise motion until the tears meet in an area of minimum wall thickness at which time the tab or cover section 122 would be removed while flange 121 and that portion of wall 119 extending between preweakened portion 123 and flange 121 will remain secured to and in communication with bag 111. At this stage, an injection needle or cannula with tubing can be inserted in through reseal device 135 and into the inside of solution container 111 for the purpose of either adding material thereto or withdrawing it.

By providing walls 24 and 124 with varying widths in a uniformly progressive manner from a minimum width to a maximum one, returning to a minimum one with the minimum and maximum widths oppositely disposed, the tamperproof units can be removed with a minimum amount of effort and in a positive manner. If desired, although of no apparent advantage the walls 24 and 124 could be constructed with a minimum width uniformly progressing in a clockwise and counterclockwise manner to a unitary maximum width or with a multiplicity of minimum and maximum wall thicknesses which are interconnected with a constantly increasing or decreasing wall portion to provide an undulating effect. Regarding unit 10, by having a central core 17 and wall 19 with skirt 27 extending down over outlet tube 20 a substantial distance, sterility of the port is assured on the outside as well as on the inside. Another important aspect in making the breakaway sections 23 and 123 is that the uniform thickness of 0.005 to 0.008 inch is not practical from a molding standpoint. It has been determined that a minimum average thickness of 0.011 is required to properly mold the part. By varying the thickness over the breakaway section, one is able to obtain the required cross sectional area for properly filling the mold cavity without increasing the thickness of the breakaway at the point where the break is initially generated.

As seen from the drawing and particularly FIGS. 4 and 7, weakened portions 23 and 123 have wall thicknesses which vary in width in a uniformly progressive manner from a minimum thickness to a maximum one. While no degree of taper is critical, it is important that the taper be such that the wall thicknesses progressively increase in two directions toward a maximum width. Further, it will be apparent that units 10 and 110 would be interchangeable on bags 11 and 111.

It should also be pointed out, although it is not of a critical matter, that tab flanges 13 and 15 have a 0.650 inch diameter and are 0.045 inch thick whereas ribs 31 and 32 are 0.062 inch in width.

Units 10 and 110 are molded from flexible polyvinylchloride. However, other resinous flexible plastic materials could be utilized such as any injection or compression moldable plastic. Further, glass could be used if desired.

While units 10 and 110 have been shown in conjunction with ports for blood bags and additive ports, respectively, it should be understood that the tamperproof units could be utilized with any container port where sterility is a factor. In such instance the container port could be employed to add or withdraw materials or administer the contents of the container.

It will thus be seen that through the present invention there is now provided a tamperproof tear open unit which is easily constructed yet can be opened with a minimum amount of effort and in a positive manner. The tear open units can be easily fabricated from existing molding equipment and result in units which are easily assembled with plastic fluid containers. The tear open units afford a sterile entry port without excessive parts being utilized in conjunction with the tear open units.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description. I claim:

1. a tamperproof breakaway port for a container comprising a tubular walled port in communication with said container, said tubular port defined by a cover section and a section secured to said container, a weakened portion separating said cover section and said section secured to said container, said weakened portion formed by a reduced wall section extending in a substantially transverse plane with respect to the longitudinal axis of said tubular port, said reduced wall section extending peripherally and into the wall of said tubular port from the exterior surface thereof and varying in width in a uniform and progressive manner from a minimum width to a maximum width.

2. The tamperproof breakaway port as defined in claim 1 wherein said reduced wall section is defined by wall sections having two minimum and maximum widths with their minimum and maximum widths oppositely disposed.

3. The tamperproof breakaway port as defined in claim 2 wherein said reduced wall sections are defined by a single groove.

4. The tamperproof breakaway port as defined in claim 3 wherein said groove is substantially V-shaped and has a compound angle of about 30°.

5. The tamperproof breakaway port as defined in claim 4 wherein the base of the V-shaped groove has a flat wall portion.

6. The tamperproof breakaway port as defined in claim 3 wherein said groove at its maximum width is approximately twice the width at its minimum width.

7. The tamperproof breakaway port as defined in claim 1 wherein said container and said tubular port are formed from a flexible plastic material.

8. The tamperproof breakaway port as defined in claim 1 wherein said cover section is formed by a cap disposed in said tubular port, said cap having a skirt and core portion terminating adjacent said weakened portion.

9. The tamperproof breakaway port as defined in claim 1 wherein said cover section and the section communicating with the container are fabricated from a unitary tubular member.

10. The tamperproof breakaway port as defined in claim 3 wherein said tubular port is substantially circular and said groove extends completely around said tubular port.

* * * * *